US010604876B2

(12) United States Patent
Mert et al.

(10) Patent No.: US 10,604,876 B2
(45) Date of Patent: Mar. 31, 2020

(54) NEEDLE CLAMP FOR SEWING MACHINE COMPRISING A NEEDLE COOLING DEVICE

(71) Applicant: Sanko Tekstil Isletmeleri San. Ve Tic. A.S., Inegol-Bursa (TR)

(72) Inventors: Serkan Mert, Inegol-Bursa (TR); Alper Cesit, Inegol-Bursa (TR); Ozgur Cobanoglu, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 54 days.

(21) Appl. No.: 15/852,258

(22) Filed: Dec. 22, 2017

(65) Prior Publication Data

US 2018/0209083 A1 Jul. 26, 2018

(30) Foreign Application Priority Data

Jan. 24, 2017 (EP) ..... 17152910

(51) Int. Cl.
*D05B 71/04* (2006.01)
*D05B 55/02* (2006.01)

(52) U.S. Cl.
CPC ..... *D05B 71/04* (2013.01); *D05B 55/02* (2013.01); *D05D 2303/40* (2013.01)

(58) Field of Classification Search
CPC ..... D05B 71/04; D05B 55/02; D05D 2303/40
See application file for complete search history.

(56) References Cited

U.S. PATENT DOCUMENTS

| | | | | |
|---|---|---|---|---|
| 2,080,322 | A * | 5/1937 | Le Vesconte | D05B 71/04 112/281 |
| 2,316,647 | A | 4/1943 | Antonio | |
| 2,423,996 | A | 7/1947 | Rubel | |
| 2,593,203 | A * | 4/1952 | Schwartz | D05B 71/04 112/226 |
| 2,690,148 | A * | 9/1954 | Adams | D05B 71/04 112/281 |
| 3,568,615 | A | 3/1971 | Stretton | |
| 4,305,339 | A * | 12/1981 | Inglis | D05B 71/04 112/281 |
| 4,480,565 | A * | 11/1984 | Harbst | D05B 71/04 112/281 |
| 2006/0048809 | A1 | 3/2006 | Onvural | |
| 2013/0285686 | A1 | 10/2013 | Malik et al. | |

FOREIGN PATENT DOCUMENTS

| | | |
|---|---|---|
| FR | 2248756 | 5/1975 |
| JP | S5138438 | 9/1976 |
| JP | 10235061 | 9/1998 |
| WO | 2005041314 | 5/2005 |

OTHER PUBLICATIONS

European Search Report issued for corresponding European patent application No. 17152910.0 dated Jul. 24, 2017.

* cited by examiner

*Primary Examiner* — Tajash D Patel
(74) *Attorney, Agent, or Firm* — Silvia Salvadori

(57) ABSTRACT

A needle clamp (1) for sewing machine (100) is provided. The needle clamp (1) comprises a body (2) at least partially made of a thermally conductive material and having retaining means (3) for constraining at least one needle (10). The needle clamp comprises a thermoelectric cooling device (5) directly or indirectly constrained to a portion of said body (2).

16 Claims, 2 Drawing Sheets

NEEDLE CLAMP FOR SEWING MACHINE COMPRISING A NEEDLE COOLING DEVICE

RELATED APPLICATION

This application claims priority to European application EP17152910.0 filed 24 Jan. 2017, the contents of which are hereby incorporated by reference as if set forth in their entirety.

TECHNICAL FIELD

The present invention relates to the field of textile industry and to the sewing process applied to the production of garments. More in detail, the present invention relates to the cooling of a needle used in sewing machines and overheated during sewing operations.

BACKGROUND

The sewing process is an important step of the production of garments. Basically, the sewing process involves fastening of fabrics, or other materials, with the help of a needle and threads. During the sewing process, needles of sewing machines, or overlock machines, are subjected to an increment of temperature due to friction between the needle and the portions of the garment that are being sewn together. For high speed sewing in overlock machines used in textile industry, needles may overheat up to high temperatures. In many circumstances, in correspondence of the sewing needle tip or needle eye, temperatures as high as 300° C. have been measured. Such high temperatures during the stitching process may damage both the textile material of the garment and the sewing needle. Moreover, on the edge of the loops, portions of the stitch and of the fabric go into melting, resulting in critical effects for both functionality and aesthetic appearance of the seam and the entire garment.

The problem of damaging the fabric material of the garment during sewing process with overheated needles is even major in the case of synthetic fibres such as spandex, lycra or other polyester-polyurethane copolymers. In fact, in such cases, the synthetic textile materials are torn or melted and covered by the sewing thread, resulting weaker in correspondence of the seam. In many cases, part of the textile material while melting sticks on the needle, causing stitching damages, torn threads and needle deterioration.

Heat is naturally dispersed from the overheated needle through spontaneous heat dispersion such as radiation, convection and conduction.

By means of thermal radiation, an object with a non-null temperature, such as the needle in the case of sewing processes, emits a radiation that result in an output thermal power. However, radiation plays a relatively small role in the needle cooling during sewing operations.

Thermal convection is a heat transfer generated by the movement of fluids that surround an object. In the case of the sewing needles, convection heat transfer is caused by the needles movement in air during the oscillating movement of needles during sewing operations.

Thermal conduction is a heat transfer generated by diffusion and microscopic collision of particles within a body or between contiguous bodies. In the case of sewing needles, it represents the most important heat dispersion component that induces needles decreasing its temperature when the machine stops. The heat flows by conduction from the overheated needle to the retaining means of the needle, to the arm of the sewing machine and to the entire sewing machine.

However, spontaneous heat dispersion through radiation, convection and conduction as described above may result not sufficient for eliminating the undesired effect of needle heating during sewing operations and the possible correlated damages caused to textile fabrics, seams and needle itself.

Document U.S. Pat. No. 2,690,148 discloses a device for cooling an overheated sewing machine needle during sewing operations. More in detail, it discloses a needle cooler comprising a hollow C-shaped body that has an inlet communicating with a flexible hose that in turn communicates with a supply of cooling medium under pressure. The C-shaped body is connected to the clamp screw that retains the needle in a fixed position during sewing operations. The lower part of the C-shaped body is a hollow chamber with a series of spaced jet outlet passages inclined so that they converge upon a common point at which the eye of the needle is located. The cooling effect of the needle is obtained by convection performed by turbulent jet streams.

However, the structure of the cooling device is complex and the cooling effect obtained by turbulent jet streams may imply the interaction of jet streams with the fabric materials that is positioned close to the eye of the needle where the jet streams converge.

Document U.S. Pat. No. 2,316,647 discloses a needle cooling device for sewing machines comprising a coolant reservoir and liquid dispensing means so that liquid coolant is applied to the needle at each reciprocation. In particular, the cooling device is provided with a container comprising an absorbent fibre able to carry the desired amount of liquid coolant. When the needle descends it will pass through the fibre and will pick up from the fibre the liquid that will cause the cooling of the needle. In this way, the needle tip and the needle eye are subject to a decrease in temperature. The cooling effect of the needle is obtained by convection performed by the liquid coolant and by conduction, performed by the contact between the sewing needle and the absorbent fibre with the liquid coolant.

However, the cooling effect is not continuous and during its movement, the needle carries the liquid coolant picked up from the absorbent fibre of the cooling device. In this way, during sewing operations, the liquid coolant can interact with the fabric material when the needle passes through the portions of the garment.

As a result, the known methods for cooling sewing needles disclose devices that use cooling fluids for cooling overheated needles during sewing operations.

According to the known art, the cooling fluids interact with the needle, causing the needle to decrease its temperature, but the cooling fluids interact with the fabric material too. This is a drawback of the know art, since cooling fluids provide invasive effects that can damage the fabric. In fact, many fabric materials are temperature sensitive and cooling fluids on the fabric may result in a deterioration of the portion in contact with the cooling fluids. Additionally, the known cooling system for sewing machine, especially those using cooling fluids, are difficult and expensive to maintain. In particular, the known cooling system requires high maintenance time and costs.

SUMMARY OF THE INVENTION

It is therefore an aim of the present invention to provide a cooling device that causes the body of the sewing needle to effectively decrease its temperature. Another aim of the present invention is to obtain an effective cooling of the needle without interacting with the fabric material too. More in detail, aim of the present invention is to provide a cooling device that causes the sewing needle to decrease its temperature preferably through a conduction heat transfer method.

Another aim of the present invention is to provide a cooling device that can be constrained to existing sewing machines without modification of the existing sewing machines.

Another aim of the present invention is to provide costs and weight savings in cooling overheated sewing needles, by means of a cooling device that can offer high efficiency and good control of the thermal power subtracted from the overheated needle.

These and other aims of the present invention are achieved by a needle clamp (needle holder) for sewing machine, comprising a body at least partially made of a thermally conductive material and having retaining means for constraining a needle. The needle clamp comprises a thermoelectric cooling device directly or indirectly constrained to a portion of the body of the needle clamp allowing heat transfer, preferably by conduction, from the needle to cool it.

The term "thermoelectric cooling devices" is used herein to indicate devices able to transform temperature differences (heat) to electric energy, and viceversa. These devices are also known in the art as Peltier/Seebeck devices. According to the present invention the thermoelectric device of the needle clamp is able to cool the needle constrained to the needle clamp. In other words, heat is transferred (preferably by conduction) from the needle clamp, and thus from the needle constrained to it, through the thermoelectric device.

According to an aspect, the thermoelectric cooling device is provided with a first side (preferably a cold side) and a second side or external side (preferably a hot side), the first side is directly or indirectly constrained to a portion of the body of the needle clamp allowing heat transfer, preferably by conduction, from the needle clamp (and thus from the needle) to the first side and then to the second side of the thermoelectric device, and thus to the external environment.

According to an embodiment, one or more heat sink can be arranged on the second side (external side of the thermoelectric device) to increase heat dissipation.

According to an aspect, the thermoelectric cooling device is provided with a hot side and a cold side, the cold side being directly or indirectly constrained to a portion of the body of the needle clamp allowing heat transfer, preferably by conduction, from the needle to said cold side and thus to external environment.

According to an aspect of the present invention, the thermoelectric cooling device comprises at least a Peltier cell, and it is constrained directly or indirectly to an external surface of the body of the needle clamp. It has to be noted that the term "directly constrained" herein refers to the direct contact of the thermoelectric cooling device with the body of the needle clamp.

According to an aspect, the thermoelectric cooling device is constrained by constraining means, as an example screws, rivets, or is constrained by interlocking the cooling device in a seat, so that the cooling device is in direct contact with the body of the needle clamp.

The term "indirectly constrained" herein refers to the interposition of an additional layer between the cooling device and the body of the needle clamp. In particular, according to an aspect of the invention, an additional layer may comprises a thermal conductive layer that is able to allow the heat flow from the body of the needle clamp to thermoelectric device, e.g. the cold side of a Peltier cell. The thermal conductive layer is advantageously an adhesive layer, as an example a thermal paste, that can indirectly constrain (i.e. constrain with the interposition of the adhesive layer) the thermoelectric device, e.g. a Peltier cell, to the external surface of the body of the needle clamp.

According to another aspect of the present invention, the thermoelectric cooling device is connected to a control unit for the regulation of the thermoelectric device, for example by a selective activation/deactivation and/or by a regulation of the electric current provided to it. Indeed, according to an aspect of the present invention, it is possible to control the heat transfer by conduction from the sewing needle to the cooling device, in order to set a predetermined temperature of the sewing needle, or to track (modify the temperature according to) a predetermined set of values of temperatures of the sewing needle.

In fact, according to the thermoelectric effect produced by the thermoelectric cooling device, according to an embodiment, the sewing needle cooling can be controlled by a different setting of the intensity of voltage across the electric poles of the thermoelectric device. In other words, according to a possible embodiment, by changing the intensity of the electric voltage across the thermoelectric device poles, the temperature of the cold side constrained to the body of the needle clamp changes and a different amount of heat will be transferred from the overheated sewing needle to the thermoelectric cooling device and thus to the external environment.

According to an aspect of the invention, the thermoelectric device is regulated, preferably by a control unit, according to feedback loop control. For example, according to an aspect, a PID controller or any other negative feedback loop control device can control the heat transferred through the thermoelectric device. For example, according to possible embodiments, a PID controller or any other negative feedback loop control device can control the current through the peltier/seebeck thermoelectric device to alter the pumped heat from the needle clamp outwards. As already mentioned above, heat can be transferred to a heat dissipation element (heat sink) in contact with the thermoelectric devices on their open side (second side) facing the external environment.

According to an aspect, a temperature sensor, such as a thermocouple, can be provided to detect temperature of the needle clamp and/or directly of the needle. The generated temperature sensor value can be used in said feedback loop control.

Advantageously, according to an embodiment, the temperature of the needle clamp and hence of the needle can easily be maintained at a constant level.

It has to be noted that, according to an aspect of the invention, the thermoelectric device can be controlled according to an open loop control system, e.g. without a feedback control discussed above. In other words, the temperature can be manually adjusted by an operator, e.g. by maintaining the temperature at a minimum that can be defined by the current system parameters.

According to another aspect of the present invention, the sewing machine has an electric circuit connected to an electric power source, and the thermoelectric cooling device is connected to said electric circuit of said sewing machine. In other words, the thermoelectric cooling device uses the same electric power source of the sewing machine for cooling the cold side of the cooling device. In this way, it is possible to use just one electric power source reducing the complexity and the encumbrance of a further electric power source different from the power source of the sewing machine.

Another aspect of the present invention provides for a method of cooling a needle retained by a needle clamp for a sewing machine, said needle clamp comprising a body at least partially made of a thermally conductive material and having retaining means for constraining at least one needle, comprising the steps of:

(a) constraining directly or indirectly a thermoelectric cooling device to a portion of said body;

(b) regulating said thermoelectric cooling device to control heat transfer from said needle clamp.

Additional aspects and features of the present invention are disclosed in the dependent claims.

An aspect of the invention also relates to the use of a thermoelectric cooling device, e.g. a Peltier cell, for cooling a needle retained by a needle clamp for a sewing machine.

BRIEF DESCRIPTION OF THE DRAWINGS

Further aspects and advantages of the present invention will be discussed more in detail with reference to the enclosed drawings, given by way of non-limiting example, wherein.

DETAILED DESCRIPTION

Figure 1:
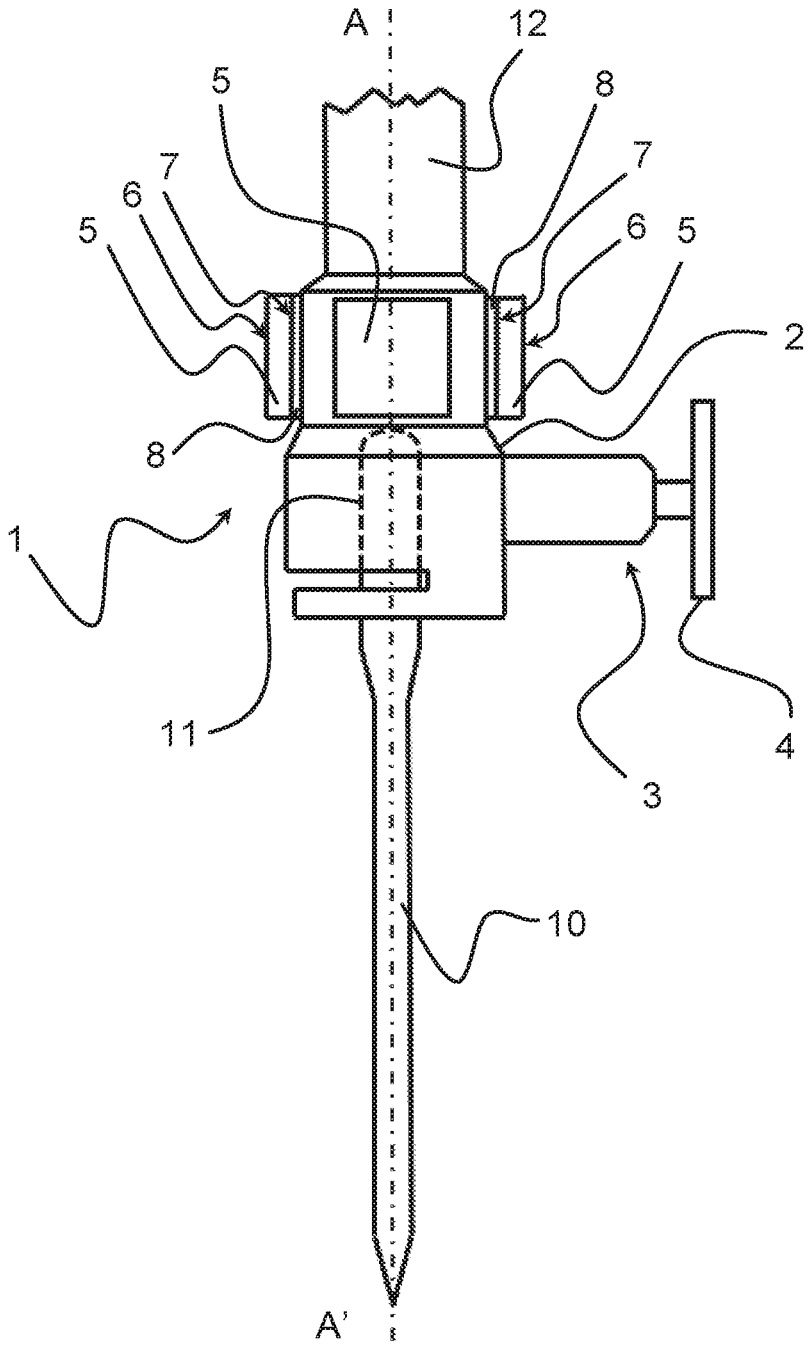
FIG. 1 is a front view of the needle clamp for sewing machine according to an embodiment of the present invention.

As for example shown in FIGS. 1-2, the needle clamp 1 according to the present invention, comprises a body 2 constrained to an arm 12 of a sewing machine. The needle clamp 1 is configured to retain a needle 10 during sewing operations. The needle 10 is retained in the needle clamp 1 by accommodating the needle 10 in a recessed seat 11 provided in the body 2 of the needle clamp 1. When the needle 10 is positioned in the recessed seat 11, retaining means 3 intended to constrain the needle 1 in a removable manner (i.e. reversibly) to the needle clamp 2.

The retaining means 3 also allow to remove the needle 1 from the recessed seat 11 of the needle clamp 1 in case of maintenance or when it is necessary to replace a used needle with a new needle, or when a needle with different characteristics has to be used according to the fabric to be sewn.

According to a possible embodiment, as for example shown in FIG. 1, retaining means 3 comprises a clamping pin and a knob 4 that when screwed in a correspondent threated hole, reversibly constrain the clamping pin and the needle 1 in the recessed seat 11 of the body 2 of the needle clamp 1. According to other embodiments not shown, the retaining means can be provided with different configuration with respect to that disclosed above and shown in the figures, provided that the needle can be retained in the needle clamp.

The recessed seat 11 accommodating the needle 10 in the body 2 of the needle clamp 1 is preferably provided with a longitudinal extension according to an axis A-A'. The axis A-A' extends in the same direction of the longitudinal axis of the needle 10, when the needle 10 is accommodated in the recessed seat 11 of the body 2 of the needle clamp 1.

The body 2 of the needle clamp 1 is at least partially made of a thermally conductive material. For example, a conductive material used for the body 2 of the needle clamp 1 is a metallic material. The retaining means 3 for retaining the needle in the recessed seat 11 in the body 2 of the needle clamp 1 is at least partially made of a thermally conductive material, as an example a metallic material.

During sewing operations, the arm 12, the body 2 of the needle clamp 1 and the needle 10 move along the axis A-A'. When the needle 10 penetrates the fabric, the friction between the sewing needle 10 and the fabric, generates the overheating of the needle 10. In fast sewing machines, the needle overheating can result in a severe increment in temperature of the needle 10, causing the damage of the seam, of the fabric, of the needle, or a combination thereof.

The needle clamp 1 according to the present invention, comprises a thermoelectric cooling device 5 constrained to the body 2 of the needle clamp 1.

As already mentioned above, according to an embodiment, the thermoelectric cooling device 5 is a device able to transfer heat from one side of the device, to the other side, by means of electric energy. The effect that correlates a difference in voltage to a difference in temperature, also known with the term thermoelectric effect, is obtained by a device comprising two types of semiconductors placed thermally in parallel and electrically in series. According to an embodiment, when electric current flows in the device, a difference in temperature between the two thermally parallel sides of the semiconductors is generated, resulting in a difference in temperature between the two sides of the device. Thermoelectric devices can be used both as cooler devices and as thermoelectric generator. Thermoelectric devices, known as Peltier cells, applies a different voltage by electric energy to obtain a difference in temperature between the two sides of the device. Thermoelectric devices, known as Seebeck cells, convert a difference in temperature between two sides of the device in electricity.

Figure 2A:
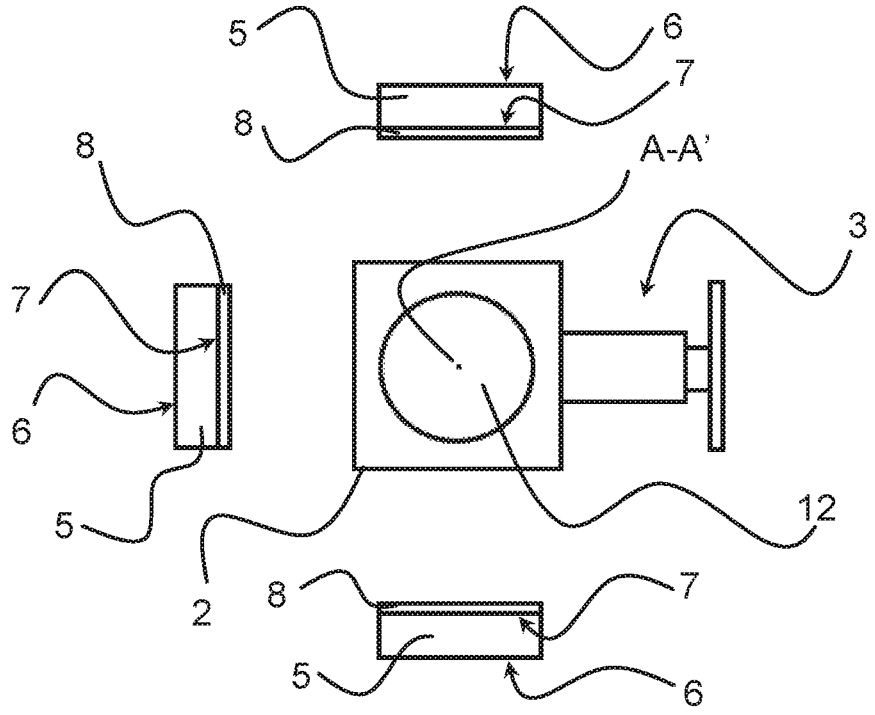
FIG. 2*a* is a top view of the needle clamp before constraining a thermoelectric cooling device to a portion of the body of the needle clamp, according to an embodiment of the present invention.

As for example shown in FIGS. 1, 2*a,b*, the thermoelectric cooling device 5, such as at least one Peltier cell, comprises a hot side 6 and a cold side 7. The thermoelectric effect is used to transfer heat from the needle clamp to a first side of the device, e.g. a cold side 7, to a second side 6, e.g. a hot side 6. According to an embodiment, electric power can be used to generate, by thermoelectric effect, a difference in temperature between the two sides 6,7 of the thermoelectric device 5, thus allowing heat transfer from the needle clamp.

The thermoelectric cooling device 5, e.g. a Peltier cell, is constrained to a portion of the body 2 of the needle clamp 1 and, more in detail, the thermoelectric cooling device 5 is constrained to a portion of the external surface of the body 2. The thermoelectric cooling device 5 extends on a portion of said body 2 of an angle $\alpha$ comprised between 0° and 360°, preferably between 0° and 270°, in a plane perpendicular to the axis A-A' that extends along the longitudinal extension of the recessed seat 11 and the longitudinal axis of the needle 10.

The thermoelectric cooling device 5 is constrained to the body 2 of the needle clamp 1 directly or indirectly.

According to an embodiment of the present invention, the cooling device 5 is directly constrained to the external surface of the needle clamp 1 by contacting the first side 7 of the cooling device 5 with a portion of the external surface of the body 2 of the needle clamp 1. Retaining means for retaining the cooling device on the body 2 in a direct constraint may comprise screws, rivets or protruding elements protruding from the external surface of the body 2 suitable to interface directly the cooling device 5, the cooling device 5 and the body 2 of the needle clamp 1 for example by interlocking the cooling device 5 in said protruding elements.

According to another possible embodiment of the present invention, the cooling device 5 is indirectly constrained to the external surface of the needle clamp 1 by interposing an additional layer between the first side 7 of the cooling device 5 and the external surface of the body 2 of the needle clamp 1. More in detail, according to an aspect of the invention, the additional layer is a thermal conductive layer 8, such as a thermal past. Advantageously, the additional thermal conductive layer is an adhesive layer that constrains the cooling device 5 on the external surface of the body 2 of the needle clamp 1.

According to this embodiment, an adhesive thermal paste adheres from one side to the cold side 7 of the cooling device 5 and on the other side to the external surface of the body 2 of the needle clamp 1.

The thermoelectric cooling device 5 is thermally in contact with the needle 10 since heat flows from the needle 10 to the cooling device 5, preferably by conduction.

According to an embodiment, heat flows from the needle 10 through the recessed seat 11 of the body 2 of the needle clamp 1, to the body 2 of the needle clamp 1, to the cold side 7 of the cooling device 5. According to another embodiment, heat flows from the needle 10 through the recessed seat 11 of the body 2 of the needle clamp 1, to the body 2 of the needle clamp 1, to the adhesive thermal paste 8, to the cold side 7 of the cooling device 5.

Advantageously, according to an embodiment of the present invention, the cooling power of the thermoelectric cooling device 5 can be controlled by the electric power supplied to the cooling device 5. The regulation of the electric power supplied to the cooling device 5 results in a regulation of the temperature of the cold side 7 of the cooling device 5. Moreover, since the intensity of the heat flow from the overheated needle to the cold side 7 of the cooling device, is a function of the difference in temperature between the needle 10 and the cold side 7 of the cooling device 5, the cooling effect of the needle 10 and the temperature of the needle 10 can be controlled by the regulation of the electric power supplied to the cooling device 5.

As already mentioned above, even if not shown in the attached figures, a heat dissipation element (e.g. heat sink) can be provided and preferably constrained to the second (external) side 6 of the thermoelectric device to increase heat transfer to the external environment.

According to a possible embodiment, even if not shown in the figures, at least one temperature sensor, e.g. a thermocouple, can be provided to detect temperature of needle and/or of the needle clamp. The generated temperature sensor value can be used to control the thermoelectric device.

It has to be noted that according to different possible embodiments, the thermoelectric device and thus the heat transfer from the needle clamp to the external environment can be carried out manually, e.g. by an operator that activates/deactivates the thermoelectric device or that regulates the electric current provided to the thermoelectric device, e.g. to a Peltier cell.

However, it has to be also noted that the heat transfer can be controlled automatically, for example by a feedback loop control of the thermoelectric device. According to this embodiment, even not shown in the attached figures, a PID controller or any other negative feedback loop control device can control the current through the thermoelectric device to alter the pumped heat (transferred heat) from the needle clamp outwards.

The regulation of the thermoelectric device can be advantageously carried out automatically e.g. by regulating the electric current provided to the thermoelectric device, e.g. to a Peltier cell. According to a possible embodiment, the sewing machine 100 has an electric circuit connected to an electric power source, and advantageously, the thermoelectric cooling device 5 is connected to said electric circuit of said sewing machine 100. In other words, the thermoelectric cooling device 5 uses the same electric power source of the sewing machine 100 for cooling the cold side 7 of the cooling device 5. In this way, it is possible to use just one electric power source reducing the complexity and the encumbrance of a further electric power source different from the power source of the sewing machine 100.

The present invention also discloses a method for cooling a needle 10 retained by a needle clamp 1 for a sewing machine 100, comprising the step of constraining directly or indirectly a thermoelectric cooling device 5 to a portion of said body 2, and the step of regulating the thermoelectric cooling device 5.

According to an embodiment, the method also comprise the step of providing electric power to said thermoelectric cooling device 5, e.g. a Peltier cell.

Figure 2B:
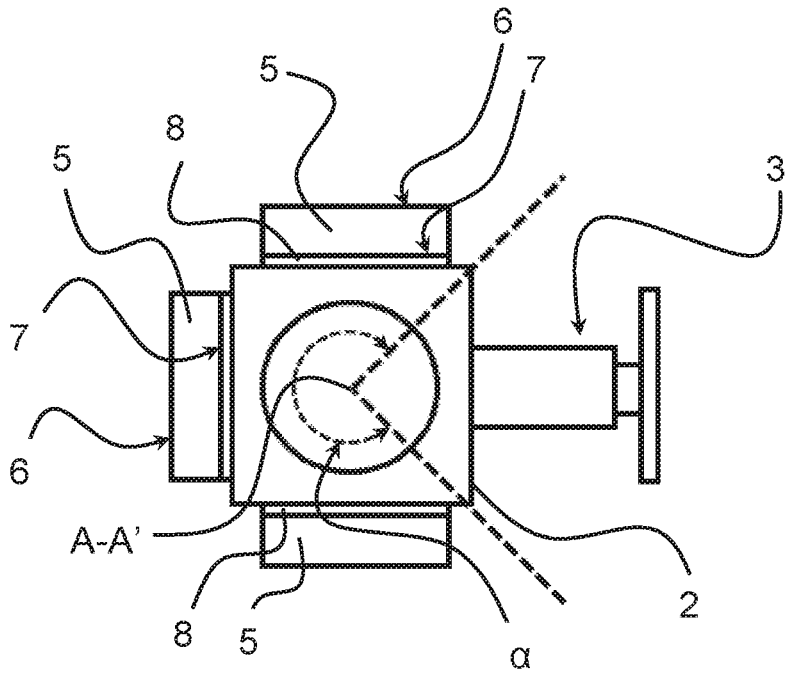
FIG. 2*b* is a top view of the needle clamp after constraining a thermoelectric cooling device to a portion of the body of the needle clamp, according to an embodiment of the present invention.

The thermoelectric cooling device 5 is indirectly constrained to a portion of the external surface of said body 2 according to step a) of the method according to the present invention, as shown in FIG. 2*a,b*. FIG. 2*a* shows a top view of the needle clamp 1 and three external free surfaces of the body 2 of the needle clamp 1. According to an embodiment, the thermoelectric cooling device 5 comprises three Peltier cells, each comprising a hot side 6 and a cold side 7. An adhesive thermal paste 8 is adhered on one side on the cold side 7 of the Peltier cells, and on the other side is suitable to adhere on a portion of the external surfaces of the body 2 of the needle clamp 1. FIG. 2*b* shows the same view of the needle clamp 1 and the thermoelectric cooling device 5 of FIG. 2*a*, after the adhesion of the Peltier cells on the portion of the external surfaces of the body 2 of the needle clamp 1, according to the present invention.

By providing electric power to the thermoelectric device 5, according to the possible step of the method, the cold side 7 of the Peltier cells decrease in temperature according to the thermoelectric effect. As long as the temperature of the cold side 7 of the thermoelectric device 5 is lower than the temperature of the needle clamp 1 and of the needle 10 overheated by friction during sewing operations, an heat flow occurs from the needle 10 to the thermoelectric device 5, and thus to the second side 6 (external side) of the thermoelectric device and thus to the external ambient.

The invention claimed is:

1. A needle clamp (1) for sewing machine (100), comprising a body (2) at least partially made of a thermally conductive material and having retaining means (3) for constraining at least one needle (10), wherein the needle clamp (1) includes a thermoelectric cooling device (5) directly or indirectly constrained to a portion of said body (2), said thermoelectric cooling device (5) having a hot side (6) and a cold side (7), said cold side (7) being directly or indirectly constrained to said portion of said body (2) allowing heat transfer from said at least one needle (10) to said cold side (7).

2. The needle clamp (1) according to claim 1, wherein said portion of said body (2) on which said thermoelectric cooling device (5) is constrained is an external surface of the body (2).

3. The needle clamp (1) according to claim 1, wherein said thermoelectric cooling device (5) is connected to a control unit for the regulation of said thermoelectric cooling device (5).

4. The needle clamp (1) according to claim 3, wherein said control unit regulates said thermoelectric cooling device (5) according to a feedback loop control.

5. The needle clamp (1) according to claim 1, wherein said retaining means (3) comprise a recessed seat (11) in said body (2) for receiving at least part of said needle (10) therein, said seat (11) having a longitudinal extension according to an axis (A-A'), said thermoelectric cooling device (5) extending on a portion of said body (2) of an angle (a) comprised between 0° and 360° in a plane perpendicular to said axis (A-A').

6. The needle clamp (1) according to claim 5, wherein said angle (a) is between 0° and 270°.

7. The needle clamp (1) according to claim 1, wherein said thermoelectric cooling device (5) comprises at least one Peltier cell.

8. The needle clamp (1) according to claim 1, wherein said thermoelectric cooling device (5) is indirectly constrained to said portion of said body (2) by the interposition of a thermal conductive layer (8).

9. The needle clamp (1) according to claim 8, wherein said thermal conductive layer (8) is an adhesive thermal paste.

10. A sewing machine (100) comprising at least one needle clamp (1), said needle clamp comprising a body (2) at least partially made of a thermally conductive material and having retaining means (3) for constraining at least one needle (10), wherein the needle clamp (1) includes a thermoelectric cooling device (5) directly or indirectly constrained to a portion of said body (2), wherein said thermoelectric cooling device (5) has a hot side (6) and a cold side (7), said cold side (7) being directly or indirectly constrained to said portion of said body (2) allowing heat transfer from said at least one needle (10) to said cold side (7).

11. The sewing machine (100) according to claim 10, wherein said sewing machine (100) has an electric circuit connected to an electric power source, said thermoelectric cooling device (5) is connected to said electric circuit of said sewing machine (100).

12. A method of cooling a needle (10) retained by a needle clamp (1) for a sewing machine (100), said needle clamp (1) comprising a body (2) at least partially made of a thermally conductive material and having retaining means (3) for constraining at least one needle (10), said method comprising the steps of:

(a) constraining directly or indirectly a thermoelectric cooling device (5) to a portion of said body (2);

(b) regulating said thermoelectric cooling device (5) to control heat transfer from said needle clamp; and (c) providing electric power to said thermoelectric cooling device (5).

13. The method according to claim 12, wherein in said step (a) said thermoelectric cooling device (5) is indirectly constrained to said portion of said body (2) with a thermal conductive layer (8).

14. The method according to claim 12, wherein said sewing machine (100) has an electric circuit connected to an electric power source and said thermoelectric cooling device (5) is connected to said electric circuit of said sewing machine (100).

15. The sewing machine (100) according to claim 10, wherein said portion of said body (2) to which said thermoelectric cooling device (5) is constrained, is an external surface of the body (2).

16. The sewing machine (100) according to claim 10, wherein said thermoelectric cooling device (5) is connected to a control unit for the regulation of said thermoelectric cooling device (5).

* * * * *